US005087003A

United States Patent [19]

Montgomery

[11] Patent Number: 5,087,003

[45] Date of Patent: Feb. 11, 1992

[54] GOLF BAG STAND

[76] Inventor: Bonnie Montgomery, Rte. 2, 2101 Chelsea Ct., Jamestown, N.C. 27282

[21] Appl. No.: 664,462

[22] Filed: Mar. 4, 1991

Related U.S. Application Data

[63] Continuation of Ser. No. 419,197, Oct. 10, 1989, abandoned.

[51] Int. Cl.[5] ..... A47B 53/00

[52] U.S. Cl. ..... 248/96; 271/71; 312/198

[58] Field of Search ..... 248/96, 146, 441.1; 271/70.2, 71; 312/198

[56] References Cited

U.S. PATENT DOCUMENTS

| | | | |
|---|---|---|---|
| D. 100,285 | 7/1936 | Pollard . | |
| D. 118,458 | 1/1940 | Smith . | |
| D. 129,390 | 9/1941 | Clouse | 211/70.2 X |
| 1,250,220 | 12/1917 | Powers | 211/71 X |
| 1,507,384 | 9/1924 | Knowlton | 248/454 |
| 2,452,929 | 11/1948 | Holcomb | 248/96 X |
| 2,645,353 | 7/1953 | Anderson, Jr. | 211/60 |
| 3,043,437 | 7/1962 | Lockie | 211/60 |
| 4,045,103 | 8/1977 | Paolino | 211/71 X |

FOREIGN PATENT DOCUMENTS

| | | | |
|---|---|---|---|
| 130382 | 12/1950 | Sweden | 248/441.1 |

*Primary Examiner*—Alvin C. Chin-Shue
*Attorney, Agent, or Firm*—Rhodes, Coats & Bennett

[57] ABSTRACT

A free-standing furniture-type stand suitable for home use for storing a bag containing golf clubs, or the like, therein off the floor and in an upright position to permit easy identification and withdrawal of the clubs when stored. The stand has a slight backwards tilt which helps to balance and to support the clubs and bag and prevent the bag from falling over. An upper bag support includes a cutout portion partially surrounds and supports the bag at its collar, permitting the golf clubs to be supported without pressure on the shafts, thereby preventing the golf club shafts from being bent or warped. Alternate embodiments include adjustable shelves to store other accessories such as shoes, golf balls, etc or more than one bag or can be folded out of the way when not in use.

5 Claims, 3 Drawing Sheets

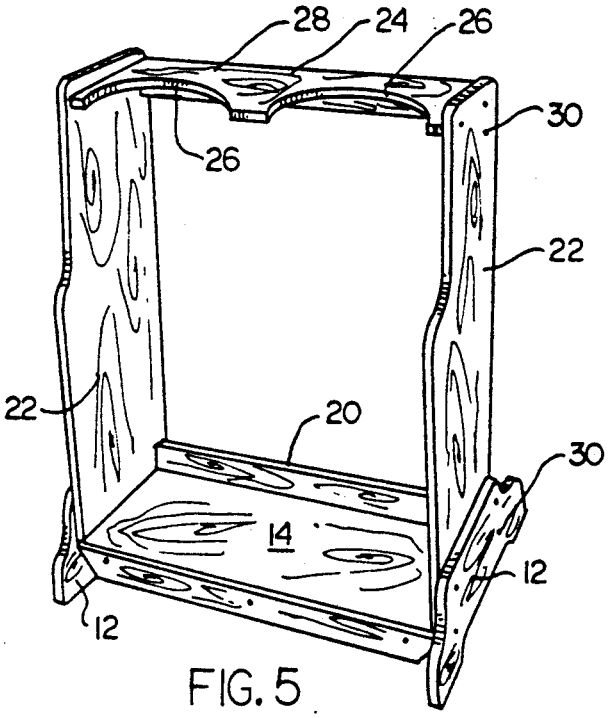
FIG. 5
FIG. 6
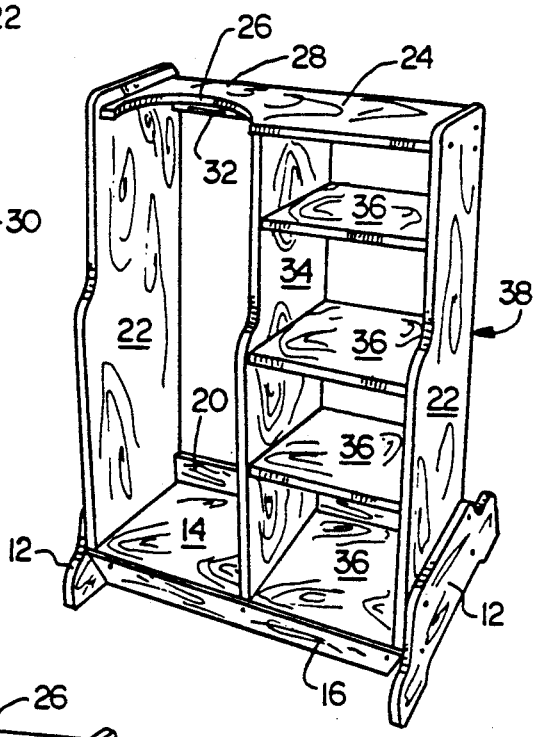
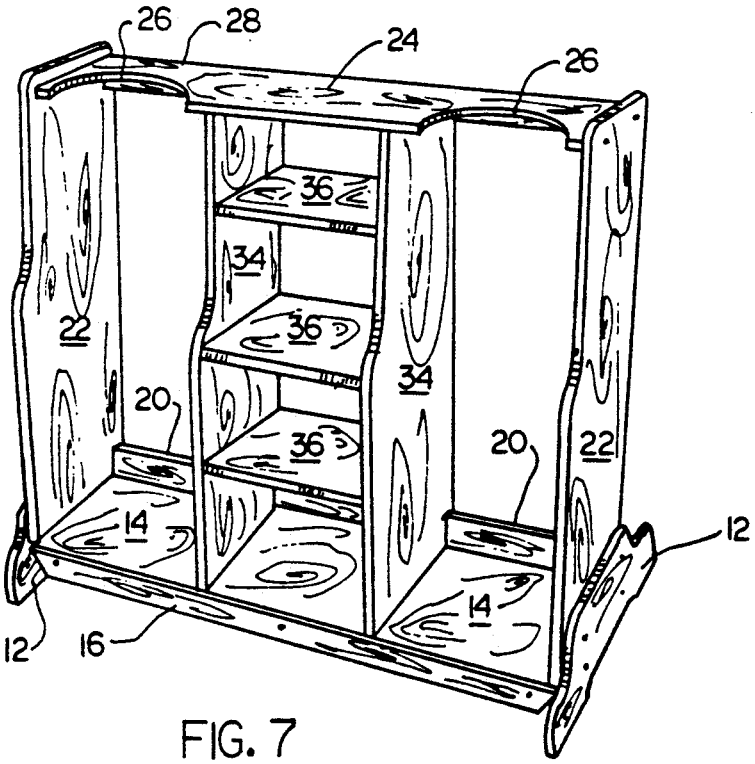
FIG. 7

GOLF BAG STAND

This application is a continuation of application Ser. No. 07/419,199 filed Oct. 10, 1989, abandoned.

BACKGROUND OF THE INVENTION

1) Field of the Invention

The present invention generally relates to storage racks and stands and, more particularly, to a storage stand of the free-standing furniture-type which is so constructed as to store bags containing golf clubs, or the like, therein off the floor and in an upright position.

2) Description of the Prior Art

Golf has become one of the world's most popular sports. At the same the cost of golf equipment, including the golf clubs, bag, and accessories, has increased substantially. For example, a complete set of clubs and carrying bag generally will sell for between one and three thousand dollars. In addition, many serious golfers have two or three complete sets of clubs. Nevertheless, most golf clubs are often left in the trunk of the golfer's car, in the basement, or in the back of a hall closet. The new, high technology types of golf club, such as graphite composites, can easily be damaged when mishandled in such a manner.

Instead, the golf bag and clubs should be stored in an upright position to prevent the golf club shafts from being bent or warped. In addition, because most of the weight of a golf club is in its head and the golf clubs heads extend outside the top of the golf bag to permit identification and withdrawal during playing, the bag should be secured to prevent its falling over. Accordingly, conventional display and storage racks, such as shown in Smith (U.S. Pat. No. Des. 118,458), Pollard (U.S. Pat. No. Des. 100,285), and Powers (U.S. Pat. No. Des. 145,103) are not suitable.

A number of golf club display racks have been used to display individual clubs. Representative examples of such racks are taught in Lockie (U.S. Pat. No. 3,043,437) and Wittek (U.S. Pat. No. 3,315,815). However, such display fixtures are directed only to displaying a number of clubs for sale within a limited space while allowing the customer to make an easy self selection.

Similarly, shipping boxes for golf clubs also separate individual clubs. Representative examples of such boxes are taught in Anderson (U.S. Pat. No. 2,645,353) and Zicko (U.S. Pat. No. 4,181,220). However, while providing protection for the clubs, such containers require the clubs to be separated and do not provide a place to store the golf bag itself.

Storage racks for home use have generally followed the retail practice of separately storing the individual clubs. Representative examples of such storage racks are taught in Kerr (U.S. Pat. No. Des. 164,503) and Robertson et al (U.S. Pat. No 1,404,893). However, these storage racks require the individual clubs to be removed from the golf bag, provide only limited protection for the clubs, and do not provide a storage place for the bag. Other storage racks, such as distributed by Austad's, Sioux Falls, S. D. as order no. GR44 attach to the wall studs in a basement or garage and suspend one or two bags by their carrying handles. However such an arrangement does not provide support for the bag, must be permanently attached to the wall, and would not be suitable in a family or recreational room.

It has thus become desirable to develop a stand for storing a golf bag and clubs which stores the clubs in an upright position to prevent the golf club shafts from being bent or warped, permits easy identification and withdrawal of the clubs when stored, and prevents the bag from falling over. In addition, the stand should not require the clubs to be removed from the bag or stored separately, thereby providing a place to store and support the golf bag itself. Finally, the stand should be suitable for home use.

SUMMARY OF THE INVENTION

The present invention solves the aforementioned problems associated with the prior art by providing a free-standing, furniture-type stand suitable for home use for storing a bag containing golf clubs, or the like, therein off the floor and in an upright position to permit easy identification and withdrawal of the clubs when stored. The stand has a slight backwards tilt which helps to balance and to support the clubs and bag and prevent the bag from falling over. An upper bag support includes a cutout portion which partially surrounds and supports the bag at its collar, permitting the golf clubs to be supported without pressure on the shafts, thereby preventing the golf club shafts from being bent or warped. Alternate embodiments include adjustable shelves to store other accessories such as shoes, golf balls, etc. or can store more than one bag or can be folded out of the way when not in use.

Accordingly, one aspect of the present invention is to provide a free standing stand for storing a bag containing golf clubs, or the like, therein off the floor and in an upright position. The stand includes a base for supporting the bottom of the bag. The base is tilted rearwardly to balance and to support the clubs and bag and prevent the bag from falling over. A pair of feet are attached to opposite sides of the base for supporting the base. A pair of side wall supports are attached at one end to the base adjacent to each of the pair of feet. An upper bag support is attached to the opposite end of the pair of side wall supports.

Another aspect of the present invention is to provide a free standing stand for storing a bag containing golf clubs, or the like, therein off the floor and in an upright position. The stand includes a base for supporting the bottom of the bag. The base is tilted rearwardly to balance and to support the clubs and bag and prevent the bag from falling over. A pair of feet are attached to opposite sides of the base for supporting the base. A pair of side wall supports are attached at one end to the base adjacent to each of the pair of feet. An upper bag support is attached to the opposite end of the pair of side wall supports. The upper bag support includes a cutout portion which partially surrounds and supports the bag at its collar, permitting the golf clubs to be supported without pressure on the shafts, thereby preventing the golf club shafts from being bent or warped.

Still another aspect of the present invention is to provide a wall mountable stand for storing a bag containing golf clubs, or the like, therein off the floor and in an upright position. The stand includes a base which is attachable to the wall for supporting the bottom of the bag. The base is tilted rearwardly to balance and to support the clubs and bag and prevent the bag from falling over. An upper bag support is attachable to the wall for supporting the top of the bag. The upper bag support includes a cutout portion which partially surrounds and supports the bag at its collar, permitting the golf clubs to be supported without pressure on the shafts, thereby preventing the golf club shafts from being bent or warped.

These and other aspects of the present invention will become apparent to those skilled in the art after a reading of the following description of the preferred embodiment when considered with the drawings.

BRIEF DESCRIPTION OF THE DRAWINGS

FIG. 5 is a perspective view of a stand similar to the stand shown in FIG. 1 except showing a second embodiment;

FIG. 6 is a perspective view illustrating a third embodiment;

FIG. 7 is a perspective view illustrating a fourth embodiment;

DESCRIPTION OF THE PREFERRED EMBODIMENT

Figure 2:
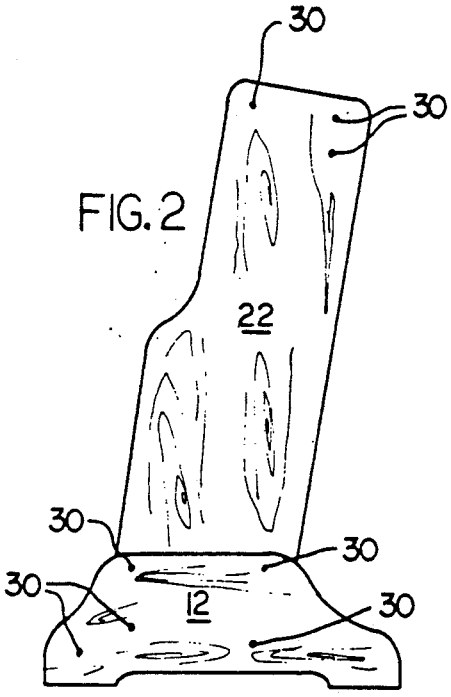
FIG. 2 is a side elevational view of the stand shown in FIG. 1.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
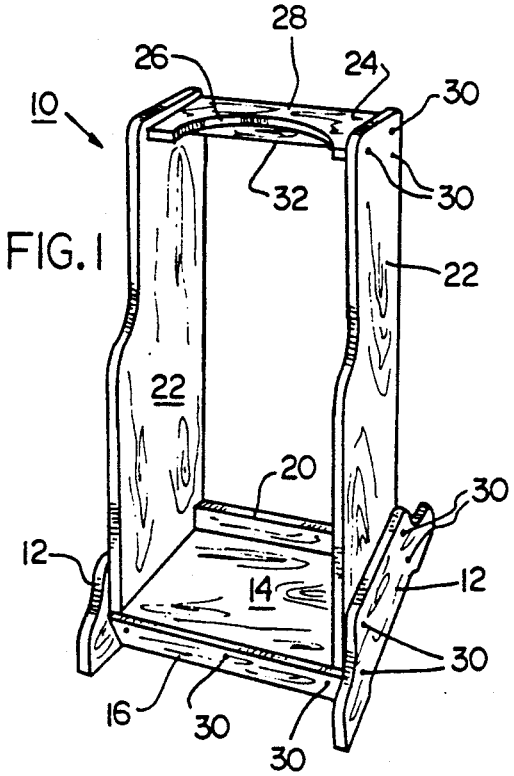
FIG. 1 is a perspective view of a golf bag stand constructed according to the present invention.

Referring to the drawings in general and to FIG. 1 in particular, it will be understood that the illustrations are for the purpose of describing a preferred embodiment of the invention and are not intended to limit the invention thereto. As best seen in FIG. 1, there is illustrated a golf stand, generally designated 10, constructed in accordance with the present invention. Stand 10 is supported by a pair of feet 12, approximately 20 inches in length, which are attached to opposite sides of a raised and inclined base 14. Base 14 includes a front kick board 16 for raising and supporting the leading edge of base 14 and a backstop 20 for positioning and preventing the golf bag (not shown) from sliding off the top of base 14. A pair of side wall supports 22 are attached at one end to inclined base 14 preferably adjacent to and parallel to each of feet 12. An upper bag support 24 is attached between the opposite ends of side wall supports 22 and is generally parallel to base 14. In the preferred embodiment, upper bag support 24 includes a cut out portion 26 which partially surrounds and supports the bag at its collar, permitting the golf clubs to be supported without pressure on the shafts, thereby preventing the golf club shafts from being bent or warped. The stand 10 has a slight backwards tilt which helps to balance and to support the clubs and bag and prevent the bag from falling over,. In the preferred embodiment, a back brace 32 is attached between the upper ends of side supports 22 adjacent to upper support 24 to provide additional strength. Also in the preferred embodiment the stand 10 is constructed from wood sheets having a thickness of approximately ¾ inch. However, other materials, such as metal and plastic, could be substituted without significantly departing from the scope of the invention.

Turning now to FIG. 2, a side elevational view of the stand 10 shown in FIG. 1 is illustrated. A portion 28 of side wall 22 may be curved inwardly without affecting its function while, at the same time, providing a more pleasing appearance and reducing the amount and weight of material required. Attachment means 30 extend through the surfaces of feet 12 and side walls 22 to engage inclined base 14 and upper bag support 26. Attachment means 30 can be any of a number of convention devices including screws, nails, pins, and dowels.

Figure 3:
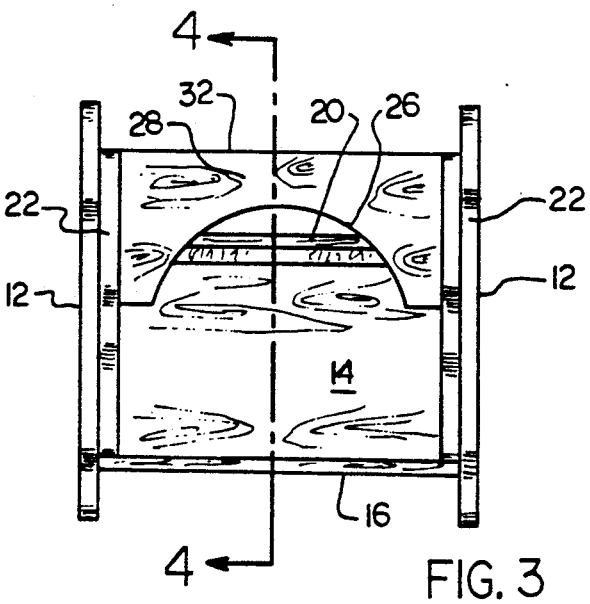
FIG. 3 is a top plan view of the stand shown in FIG. 1.

Turning next to FIG. 3, because of the slight backwards tilt of the stand 10, upper bag support 24 is offset with respect to base 14. Cutout portion 26 preferably is circular with a radius of approximately 5¼ inches. It has been found that this is sufficient to accommodate the majority of golf bags in use. In the preferred embodiment cutout portion 26 is less than a full half circle and has a depth of approximately 4 inches.

Figure 4:
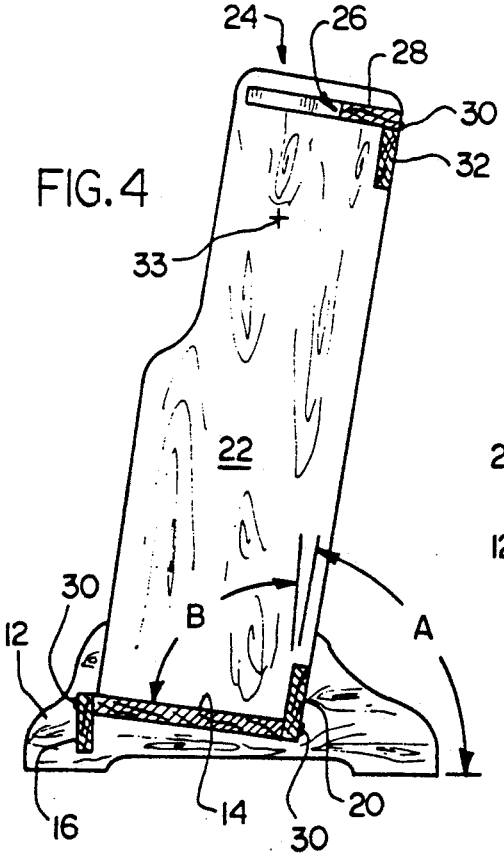
FIG. 4 is a vertical cross-sectional view of the stand shown in FIG. 3, taken along line 4—14.

As best seen in FIG. 4, stand 10 is tilted slightly backward which helps to balance and to support the clubs and bag and prevent the bag from falling over. In the preferred embodiment angle A is between 70 and 80 degrees with 75 degrees being preferred. This results in a tilt of base 14 of approximately 15 degrees. Feet 12 extend backward approximately 2½ inches further than side wall 22 thereby allowing the stand 10 to be positioned adjacent to a vertical wall without the upper portion of stand 10 hitting the wall and, at the same time, also permitting individual golf clubs to be withdrawn from the bag without striking the wall.

In the preferred embodiment upper bag support 24 is positioned approximately 32 inches from the surface of base 14. This arrangement permits cutout portion 26 to contact and support a bag at its collar, permitting the golf clubs to be supported without pressure on the shafts, thereby preventing the golf club shafts from being bent or warped. Cutout portion 26 does not extend completely through upper bag support 24. Instead there remains a rim 28 of approximately 2½0 inches adjacent to cutout portion 26 which prevents any other part of the bag from contacting the stand 10 and, in addition, serves to strengthen the stand 10. Furthermore, since, in the preferred embodiment, both the upper bag support 24 and base 14 are aligned along the rearward edge of side wall supports 22, rim 28 is operable to tilt the golf bag slightly forward at an included angle of approximately 4½ degrees. This arrangement results in angle B being between 80 and 90 degrees and preferably about 84 degrees. As a result, the effective tilt of base 14 is higher since the bottom portion of the golf bag is somewhat wedged between the upper surface of base 14 and backstop 20.

As discussed above, angle A is preferably between 70 and 80 degrees and angle B is preferably between 80 and 90 degrees. Furthermore, in the preferred embodiment, angles A and B are selected to position the center of gravity 33 of the golf bag adjacent to or rearward of the intersection of base 14 and backstop 20. In the preferred embodiment angles A and B are about 76 degrees and about 84 degrees, respectively. This arrangement further stabilizes the bag by reducing or eliminating the tendency of the bag to fall forward.

FIG. 5 is a perspective view of a stand similar to the stand 10 shown in FIG. 1 except having its width increased to permit the addition of a second cutout 26 adjacent to the first for accommodating a second bag.

FIG. 6 is a perspective view of a stand similar to the stand 10 shown in FIG. 1 except having its width increased to permit the addition of a third side wall 34 between side wall 22 and adjacent to the cutout 26 for supporting a plurality of shelves 34 which can be used to store golf shoes and other accessories. A backing 38 can be attached to the rear edge of the stand 10 to enclose the back of the shelves 34.

FIG. 7 is a perspective view of a stand similar to the stand 10 shown in FIG. 1 except having its width increased to permit the addition of a second cutout 26 for accommodating a second bag and the addition of a pair of side walls 34 between the first and second cutouts for supporting a plurality of shelves 34 which can be used to store golf shoes and other accessories. A backing 38 can be attached to the rear edge of the stand 10 to enclose the back of the shelves 34.

Figure 8:
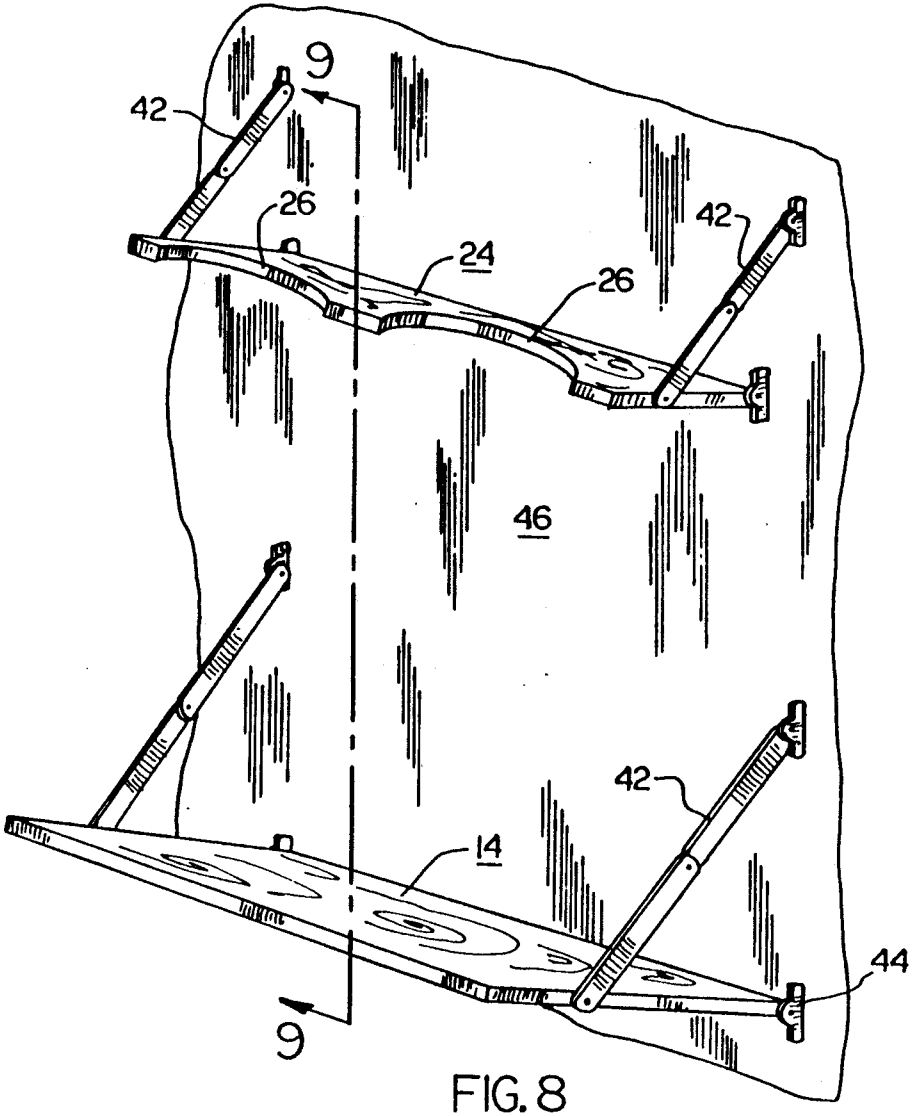
FIG. 8 is a perspective view of an alternative embodiment of a golf stand constructed according to the present invention.

Turning now to FIG. 8 there is shown a perspective view of an alternative embodiment of a wall mountable golf bag stand, generally designated 40, constructed according to the present invention. The stand 40 is functionally similar to the stand 10 shown in FIG. 1. Stand 40 includes an inclined base 14 and an upper bag support 24. Base 14 and upper bag support 24 are attachable to wall 46 by conventional hinges 42 and are maintained in position by braces 44. Hinges 42 and braces 44 can be the conventional folding type, thereby permitting stand 40 to be folded out of the way when not in use.

Figure 9:
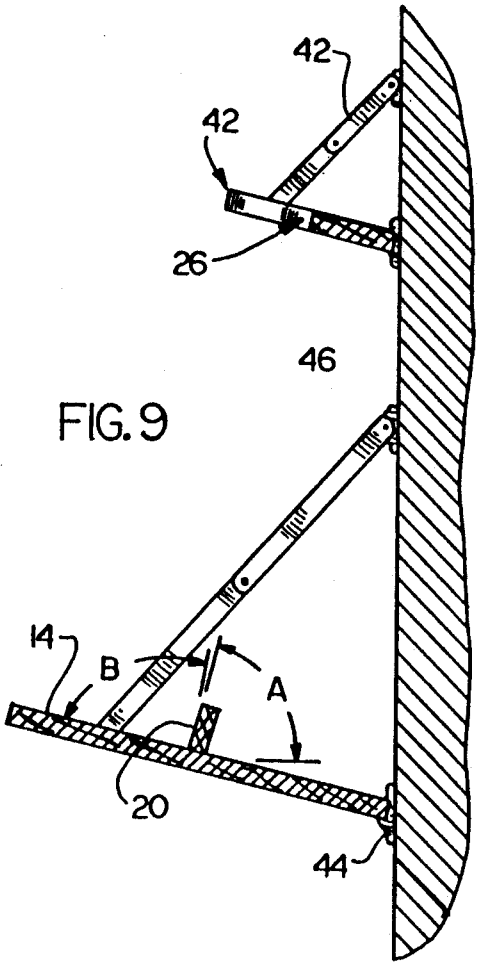
FIG. 9 is a vertical cross-sectional view of the stand shown in FIG. 8, taken along line 9—9.

Turning finally to FIG. 9 is shown a vertical cross-sectional view of the stand shown in FIG. 8, taken along line 9—9. Like stand 10 shown in FIG. 4, stand 40 has a slight backwards tilt which helps to balance and to support the clubs and bag and prevent the bag from falling over. In the preferred embodiment angle A is between 70 and 80 degrees with 76 degrees being preferred. This results in a tilt of base 14 of approximately 14 degrees. Upper bag support 24 and base 14 are extended backward approximately 2½ inches and 5 inches, respectively, thereby allowing the stand 40 to be attached directly to wall 46 and, at the same time, permitting individual golf clubs to be withdrawn from the bag without striking the wall 46. Since, in the preferred embodiment, both extended upper bag support 24 and base 14 are aligned along the wall 46, cutout 26 is operable to tilt the golf bag slightly forward at an included angle of approximately 4½ degrees. This arrangement results in angle B being less than 90 degrees and preferably between 80 and 90 degrees. As a result, the effective tilt of base 14 is improved since the bottom portion of the golf bag is somewhat wedged between the upper surface of base 14 and backstop 20.

As discussed above with respect to FIG. 4, angle A is preferably between 70 and 80 degrees and angle B is preferably between 80 and 90 degrees. Furthermore, in the preferred embodiment, angles A and B are selected to position the center of gravity of the golf bag adjacent to or rearward of the intersection of base 14 and backstop 20. In the preferred embodiment angles A and B are about 76 degrees and about 84 degrees, respectively. This arrangement further stabilizes the bag by reducing or eliminating the tendency of the bag to fall forward.

Certain modifications and improvements will occur to those skilled in the art upon reading of the foregoing description. It should be understood that all such modifications and improvements have been deleted herein for the sake of conciseness and readability but are properly within the scope of the following claims.

I claim:

1. A free standing stand of the type which is positioned against a vertical wall for storing a pair of bags containing golf clubs, or the like, therein off the floor and in an upright position, comprising:

(a) a base for supporting the bottom of the bags, said base being tilted backward to balance and to support the clubs and bags and prevent the bags from falling over;

(b) a backstop attached to said base to limit the rearward position of the bags on said base;

(c) a pair of feet attached to opposite sides of said base for supporting said base;

(d) a pair of slanted side wall supports attached at one end to said base adjacent to each of said pair of feet;

(e) an upper bags support, said upper bags support including a planar member attached to the opposite end of said pair of said wall supports, said planar member being aligned substantially parallel to said base for supporting the bottoms of the bags, planar member includes a pair of cutout portions which partially surrounds and supports the bags at their collar, permitting the golf clubs to be supported without pressure on the shafts, thereby preventing the golf club shafts from being bent or warped, wherein said base and said cutout portions of said upper bags support form an included angle, said included angle is less than 90 degrees, thereby wedging the bottoms of the bags between the upper surface of said base and said backstop, wherein said pair of feet extend rearward further than said pair of side wall supports, thereby allowing said stand to be positioned against said vertical wall without the upper portion of said stand hitting said wall and, at the same time, also permitting individual golf clubs to be withdrawn from the bags without striking said wall; and an upstanding cabinet located between said cutout portions having a plurality of shelved portions for storing shoes or the like.

2. The stand according to claim 1, wherein said pair of side wall supports are tilted backward at an angle of between about 70 and 80 degrees.

3. The stand according to claim 2, wherein said pair of side wall supports are preferably is tilted backward at an angle of about 75 degrees.

4. The stand according to claim 1, wherein said base and said cutout portion of said upper bag support define an included angle of between about 80 and 90 degrees.

5. The stand according to claim 4, wherein said included angle is about 86 degrees.

* * * * *